United States Patent [19]

Nick

[11] 4,288,173

[45] Sep. 8, 1981

[54] EXPANSION AND CONTRACTION JOINT ASSEMBLY

[76] Inventor: Albert T. Nick, 3545 Flowers Dr., Montgomery, Ala. 36109

[21] Appl. No.: 105,466

[22] Filed: Dec. 19, 1979

[51] Int. Cl.[3] ..... E01C 11/10

[52] U.S. Cl. ..... 404/49; 52/396; 404/65; 404/66

[58] Field of Search ..... 52/396, 573; 404/49, 404/50, 64, 65, 67, 69, 66

[56] References Cited

U.S. PATENT DOCUMENTS

| | | | |
|---|---|---|---|
| 3,308,726 | 3/1967 | Dreher | 404/67 |
| 3,469,510 | 9/1969 | Worson | 404/69 |
| 3,896,597 | 7/1975 | Deason | 404/64 |

*Primary Examiner*—John E. Murtagh
*Attorney, Agent, or Firm*—Jones, Tullar & Cooper

[57] ABSTRACT

An expansion and contraction joint assembly for use with installations of tile, slate or marble floors or the like is disclosed. The joint assembly is comprised generally of a base or lower component, a core receiving or upper component, and a cap component. The base component is placed on the floor or concrete slab and the core or upper component is inserted into the base and positioned with its upper end flush with the surface of the floor by the cap. A suitable core material is placed into the upper component to provide a joint assembly which compensates for expansion or contraction of the floor or setting bed thereby eliminating buckling and cracking of the floor.

2 Claims, 18 Drawing Figures

EXPANSION AND CONTRACTION JOINT ASSEMBLY

FIELD OF THE INVENTION

The present invention is directed generally to an expansion and contraction joint. More particularly, the present invention is directed to a multi-component expansion and contraction joint assembly. Most specifically, the present invention is directed to a joint assembly having a base component, an upper component and a cap component. The base component is positioned on the concrete slab or subflooring onto which the setting bed is placed. The core or upper component has a lower portion that cooperates with an open part of the base component so the two telescopingly engage. The height of the two engaged components is adjusted to the surface of the tile and the cap component holds the assembly at the proper height until the setting bed and grout have dried and set. The cap has detachable tabs and engages locking slots in the upper component. The upper component has an upper chamber which is filled with a suitable resilient material to compensate for expansion and contraction of the floor into which the joint assembly in accordance with the present invention is placed.

DESCRIPTION OF THE PRIOR ART

Tile, slate, marble, and the like flooring materials are well known and are used in a number of applications. Conventionally these floorings are set in a bed and grout is used to fill in spaces between the individual tiles. The setting bed, as it is called, may be Portland cement and sand mix or some other type of mortar or the like which is spread on a concrete slab or other subflooring such as plywood. This setting bed adheres or bonds to the subfloor and to the tiles, or pieces of slate or marble which are positioned, in a spaced array, on the bed. The spaces between the tiles are filled with grout which also bonds to the tiles and to the setting bed to form a solid floor.

A problem often arises when the setting bed, concrete slab, subflooring or other underlayment expands or contracts. Such expansion and contraction may be due to temperature changes, varying humidity, the presence or absence of water or other liquids, and the natural settling and shifting which all structures are subjected to. This expansion and contraction is communicated to the grout, and the flooring tiles. The result is apt to be cracking or buckling of the flooring, breakage of the flooring, or cracking of the setting bed or grout. All of these expansion and contraction related problems have been remedied by regrouting, by replacement of cracked or broken floor tiles, or by a complete removal and replacement of the affected area. Such repair or replacement is expensive, disruptive of the area in which the work is being done, and is generally an unsatisfactory treatment since the floor will quite probably expand or contract again.

Numerous solutions such as non-hardening grouts, substitution of fibrous strips for the grout, different types of materials for use as setting beds and the like have been tried with generally unsatisfactory results. They have either been difficult to work with, have performed poorly, have not held up to the wear they are subject to, or have not been acceptable in appearance.

Joint assemblies for use between sections of concrete highways, driveways, parking lots and the like are known in the art. These have also either not been adapted for use in building flooring or have not proved satisfactory.

The expansion and contraction of floors and the resultant damage to tile, slate, marble and other such floors has remained a problem for the contractor installing the floor and the owner of the building. The prior remedies have been unsatisfactory, or commercially unfeasible and have not provided an acceptable solution to the problem.

SUMMARY OF THE INVENTION

It is an object of the present invention to provide an expansion and contraction joint assembly.

Another object of the present invention is to provide an expansion and contraction joint assembly having three components.

A further object of the present invention is to provide an expansion and contraction joint suitable for use with various thicknesses of setting beds.

Still another object of the present invention is to provide an expansion and contraction joint which can be used at the edge of a wall as well as in the middle of the floor.

Yet a further object of the present invention is to provide an expansion and contraction joint assembly having space for receipt of a flowable, resilient, synthetic core.

As will be discussed in greater detail in the description of preferred embodiments set forth hereinafter, the expansion and contraction joint assembly in accordance with the present invention is comprised generally of three cooperating components; a base or lower element, a core or upper element, and a cap component having detachable tabs. The base component is an elongaged, generally rectangular channel which is placed on the concrete slab or subflooring. The core or upper component telescopingly engages the base and is placed with its upper edge level with the upper surface of the floor tiles. This upper component is also generally channel shaped and can receive a flowable synthetic core in an upper chamber portion. This core also acts to absorb expansion and contraction. The cap component is used to hold the upper component in place during hardening of the setting base and grout and to secure adjacent sections of the upper component together, if necessary.

The expansion and contraction joint assembly in accordance with the present assembly extends from the concrete slab or subflooring upwardly to the surface of the floor tiles. The joint assembly thus prevents either buckling or cracking of the floor tiles, the grout, or the setting base. Accordingly, expensive and time consuming repairs and replacement of floors is largely eliminated.

The expansion and contraction joint assembly in accordance with the present assembly is made from plastic components, is light and easy to work with, and is not expensive. The elements can be cut to the desired size by conventional means and do not require any special tools to install. The joint assembly can be installed while the rest of the flooring is being placed and does not materially add to the time required to install the floor.

In contrast to existing joints, the expansion and contraction joint assembly in accordance with the present invention is not expensive, is easy to use, is long lasting and, most importantly, is effective in largely eliminating buckling or cracking of floors due to expansion or contraction.

BRIEF DESCRIPTION OF THE DRAWINGS

While the novel features of the expansion and contraction joint assembly in accordance with the present invention are set forth with particularity in the appended claims, a full and complete understanding of the invention may be had by referring to the description of preferred embodiments as set forth hereinafter and as may be seen in the accompanying drawings in which:

DESCRIPTION OF PREFERRED EMBODIMENTS

Figure 1:
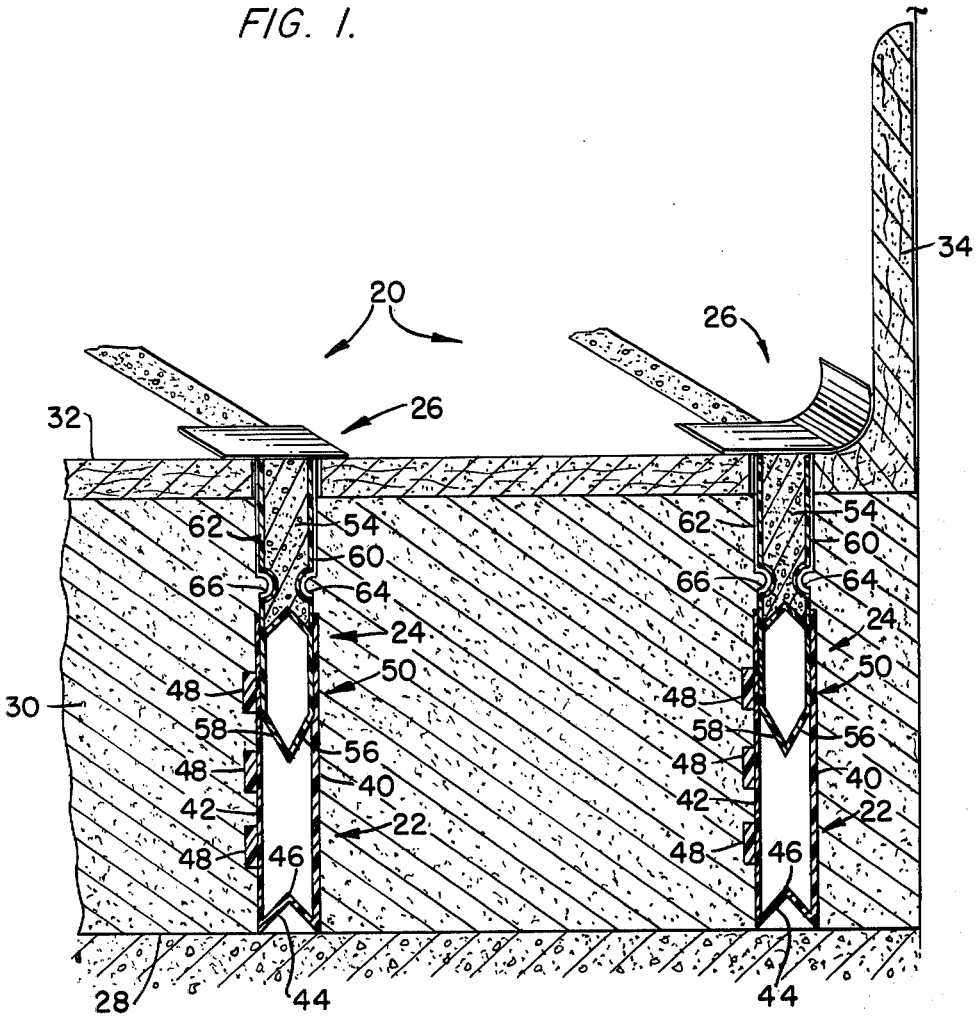
FIG. 1 is a perspective view, partly in cross-section, of a first preferred embodiment of an expansion and contraction joint assembly in accordance with the present invention and showing the joint assembly in place.

Turning initially to FIG. 1, there may be seen generally at 20 a first preferred embodiment of an expansion and contraction joint assembly in accordance with the present invention. Joint assembly 20 is comprised of three cooperating and interacting components, a base component 22, an upper or core component 24 and a cap component 26. As may be seen in FIG. 1, the installation of the expansion and contraction joint assembly is shown in two locations. The joint assembly in each installation is the same.

A concrete slab 28 is shown in FIG. 1 as the floor on which the tile or the like is to be installed. It will be understood that slab 28 could be, for example, plywood or other subflooring or could be any other material on which a finished floor is to be installed. A setting bed 30 is placed on concrete slab 28 and suitable floor tiles 32 and a tile base 34 are placed on the setting bed. This tile installation is well known in the art and forms no part of the present invention. The setting bed 30 may be any of the known materials intended for this use. Floor tiles 32 can be quarry tile, ceramic tile, slate, marble, or any other similar material normally used for flooring. Conventionally, the tiles 32 are placed on setting bed 30 with spaces between adjacent tiles, and a grout composition is then used to fill the spaces between the tiles. In the present invention, the expansion and contraction joint assembly 20 is used instead of grout between some or all of the tiles. The number of joint assemblies used will depend on the nature of the installation and the severity of the expansion and contraction expected.

Figure 2:
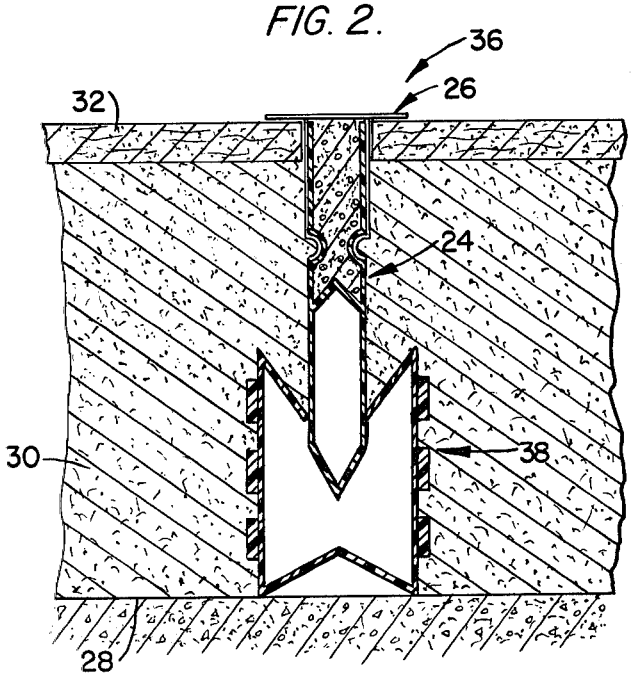
FIG. 2 is a cross-sectional view of a second preferred embodiment of the expansion and contraction joint of the present invention and showing the joint installed.
Figure 3:
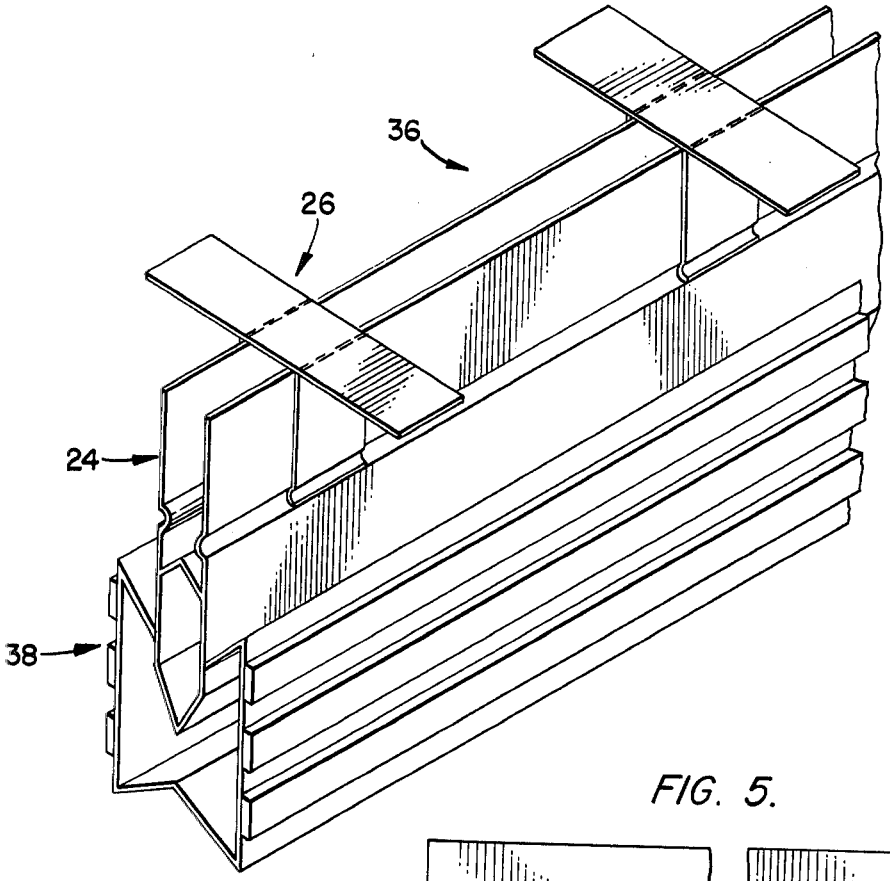
FIG. 3 is a perspective view of the joint assembly of FIG. 2 showing the joint assembled but not installed.
Figure 4:
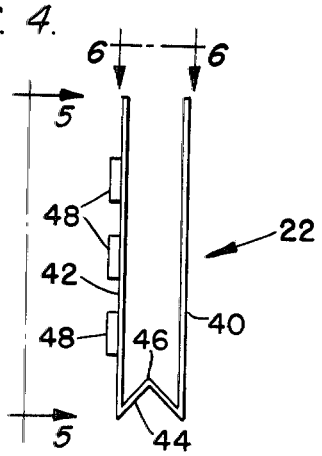
FIG. 4 is an end view of base component of the first preferred embodiment of the expansion and contraction joint assembly of FIG. 1.
Figure 5:
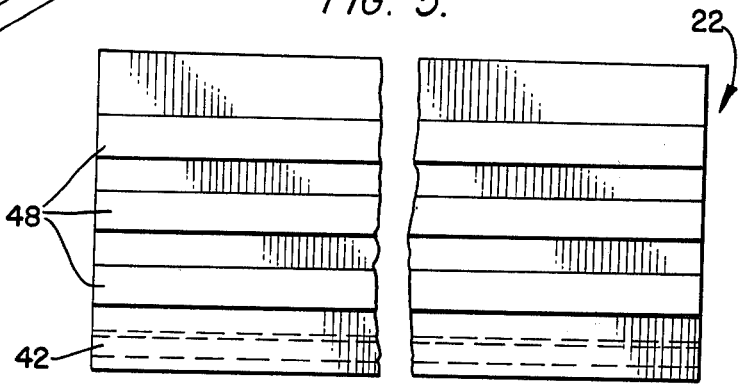
FIG. 5 is a side elevation view of the base component of FIG. 4, taken along line 5—5 of FIG. 4.
Figure 6:
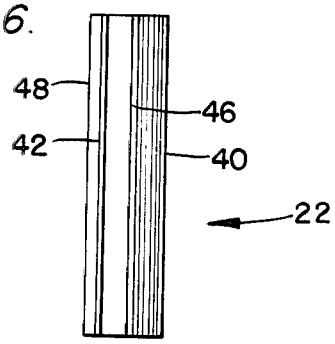
FIG. 6 is a top view of the base component of FIG. 4, taken along line 6—6 of FIG. 4.
Figure 7:
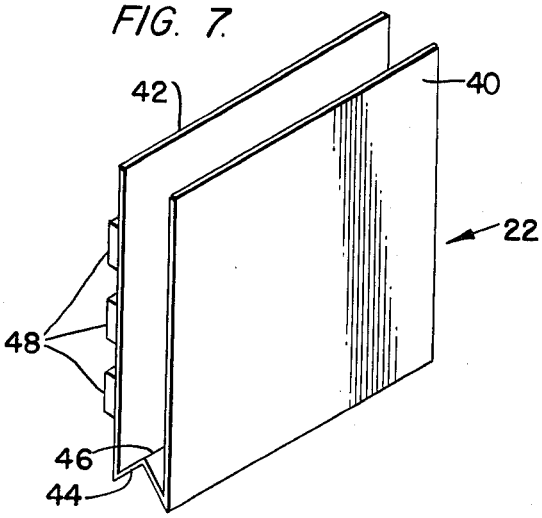
FIG. 7 is a perspective view of the base component of FIG. 4.

Turning now to FIGS. 2 and 3, there may be seen a second preferred embodiment 36 of the expansion and contraction joint assembly in accordance with the present invention. Joint assembly 36 is generally similar to joint assembly 20 and like components in each are correspondingly numbered. Joint assembly 36 is comprised of the cap 26 and upper components 24 of joint 20 but has a differently structured base component 38 which will be discussed in greater detail hereinafter.

Referring now to FIGS. 4–7, there may be seen the base component 22 of the first preferred embodiment of the joint assembly. Base component 22 is a generally elongated channel shaped element having spaced side walls 40 and 42 and a connecting bottom web 44. This connecting web 44 is, as may be seen most clearly in FIG. 4 formed with an upwardly extending fold line or pleat 46 which extends into the channel between the walls 40 and 42. This allows base 22 to expand and contract in the horizontal direction in an accordian fashion. A plurality of spaced external locking ridges 48 are formed on one side wall of base component 22 with, in the preferred embodiment, these locking ridges being spaced on wall 48 and extending therealong in the lengthwise direction of base 22.

As may be seen in FIG. 1, when the expansion and contraction joint assembly is installed, the base component is placed with the lower portion of walls 40 and 42 contacting the slab 28. The setting base 30 cooperates with the spaced locking ridges to hold the base 22 in place. Expansion or contraction of the setting base is taken up by compression or expansion of the base component 22 so cracking and breaking of the setting base is eliminated. In the preferred embodiment, base 22 is made of inert material such as plastic having a wall thickness of 0.025 inch. The height of the walls is approximately 2 inches, the channel has a width of $\frac{3}{8}$ of an inch and the bottom wall extends upwardly approximately $\frac{1}{4}$ of an inch. The length of the base 22 can be varied as required and can be cut to any desired length by conventional tools.

Figure 8:
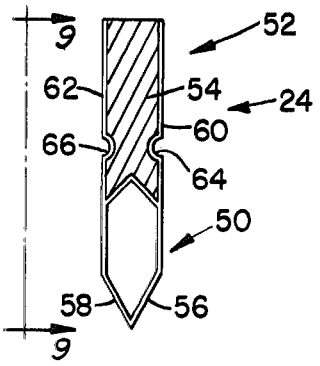
FIG. 8 is an end view of the upper component of the expansion and contraction joint assembly in accordance with the present invention and showing the core material in place.
Figure 9:
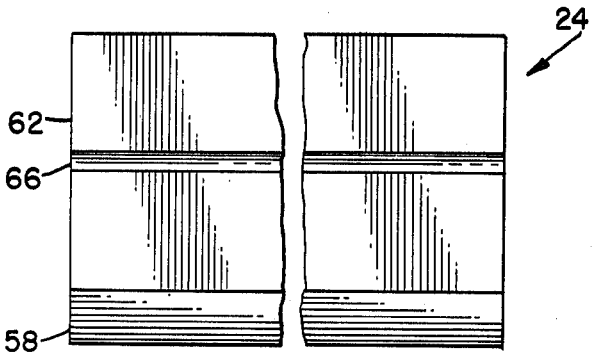
FIG. 9 is a side elevation view of the upper component of FIG. 8, taken in the direction of line 9—9 in FIG. 8.
Figure 10:
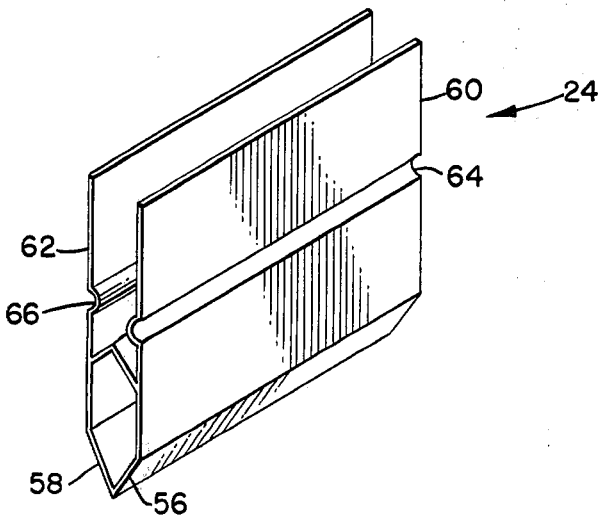
FIG. 10 is a perspective view of the upper component of FIG. 8 but with the core material not shown for clarity.
Figure 11:
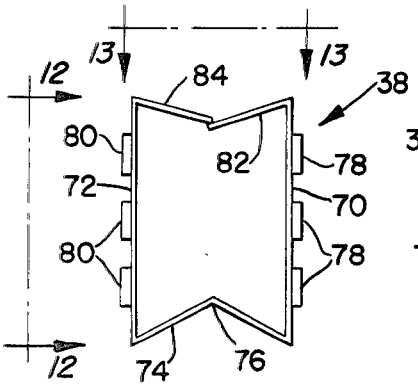
FIG. 11 is an end view of the base component of the second preferred embodiment of the expansion and contraction joint assembly in accordance with the present invention, as seen in FIGS. 2 and 3.
Figure 12:
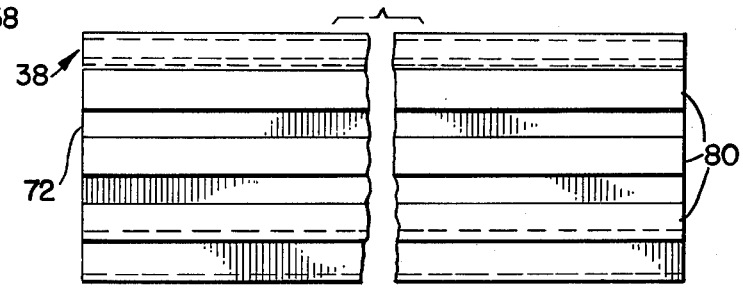
FIG. 12 is a front elevation view of the base component of FIG. 11, taken along line 12—12 of FIG. 11.
Figure 13:
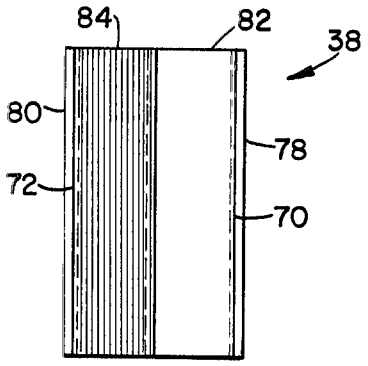
FIG. 13 is a top plan view of the base component of FIG. 11, taken along line 13—13 of FIG. 11.
Figure 14:
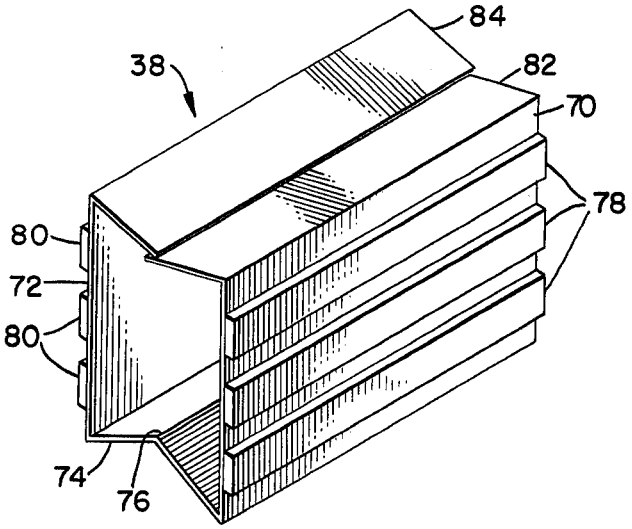
FIG. 14 is a perspective view of the base component of FIG. 11.

The upper component 24 is shown in FIGS. 8–10 and is a generally rectangular element having a wedge shaped lower portion 50 and an open upper chamber 52 which can receive a flowable, synthetic, resilient core material 54, as seen in FIG. 8. The lower portion 50 of component 22 terminates in tapered side walls 56 and 58. These side walls fit within the opening in base component 22, as may be seen in FIG. 1. The upper walls 60 and 62 of the upper chamber 52 of upper component 24 include elongated lock slots 64 and 66 which are formed as inwardly extending concave recesses. These lock slots cooperate with portions of the cap component in a manner as will be discussed hereinafter.

Upper component 24 is open at its top to receive the synthetic core material 54 which acts to compensate for expansion and contraction of the setting bed and the floor tiles which are positioned in the setting bed. A suitable core material 54 is a synthetic rubber and cork composition manufactured by Armstrong Cork Company of Lancaster, PA and identified as their part No. RK374. This core material is gray in color but could be given different colors to blend with whatever grout color is being used. It will be understood that a number of suitable materials could be used for core material to be placed in open upper chamber 52 of upper component 24 of the joint assembly. The core material should be resilient so that it can handle expansion and contraction of the floor and should also be durable so that it will wear as well as the floor surface.

In the preferred embodiments, the upper component 24 is made of an inert material such as plastic, is ⅜ of an inch wide, and is approximately 2 inches deep with lock slots of 1/16 inch radius. This component can also be provided in strips of convenient length and can be cut to size, as desired. The plastic is 0.025 inches thick with the tapered lower end being generally ⅜ of an inch deep. It will be understood that these sizes of the upper component 24 and the lower component 22 are meant to be exemplary and that various other sizes could be used, if desired. The sizes of the upper and lower components are selected so that the lower tapered portion 50 of the upper component 24 will fit into the open channel of the base component 22 so that the two components will telescopingly engage each other to allow adjustment to compensate for different thicknesses of setting bed 30 and floor tiles 32.

The second preferred embodiment of base component 38 may be seen more clearly in FIGS. 11–14. Base component 38 is generally similar in construction to base component 22 but is wider and has locking ridges on both sides. As may be seen in FIGS. 11–14, base component 38 is generally an elongated channel having side walls 70 and 72, and a bottom 74 which extends upwardly into the channel between the side walls 70 and 72. An elongated pleat or crease 76 is placed in the middle of bottom 74 so that the base component 38 can expand and contract horizontally. Spaced locking ridges 78 and 80 extend along side walls 70 and 72, respectively along the length of base component 38 and perform the same functions as do ridges 48 of base component 22. Base component 38 is also provided with a pair of overlapping top flaps 82 and 84. As may be seen in FIGS. 2 and 3, base component 38 of the second preferred embodiment is wider than the cooperating upper component 24. The overlapping flaps 82 and 84 thus allow passage of the upper components 24 into the interior of the base component 38 but prevent material of the setting base 30 from entering into the interior of base 38.

In the second preferred embodiment shown in FIGS. 2, 3, and 11–14, the base component 38 is formed of the same plastic as the rest of the components, is approximately 1 inch wide and is 1½ inches deep. Base component 38 can also be provided in strips of suitable length which can then be cut to suit the installation. The depth of penetration of the upper component 24 into the base component 38 will depend on the thickness of the setting bed and the floor tile being used. Base component 38 is suitable for use in areas where a large amount of expansion or contraction is to be expected. Because of its width, base component 38 of the second preferred embodiment would not be as suitable for use adjacent a wall; i.e. would not be as well suited for use in substitution for the base component 22 shown in the right of FIG. 1.

The third component of the expansion and contraction joint assembly in accordance with the present invention is the cap component 26, which may be seen in use in FIGS. 1–3, and which is also shown in FIGS. 15–18. Cap component 26 is generally in the shape of an inverted channel and has a pair of spaced downwardly extending legs 90 and 92 which are joined across their tops by a removable tab 94, the junctures between the legs 90 and 92 and tab 94 being provided with suitable perforations 96 and 98 so that the tab 94 can be removed once the cap component has been installed.

Figure 15:
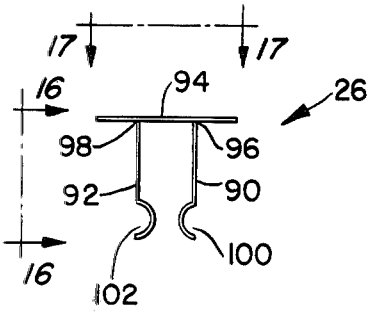
FIG. 15 is an end view of the cap component of the expansion and contraction joint assembly in accordance with the present invention.
Figure 16:
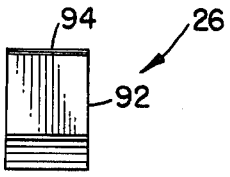
FIG. 16 is a side elevation view of the cap component of FIG. 15, taken along line 16—16 of FIG. 15.
Figure 17:
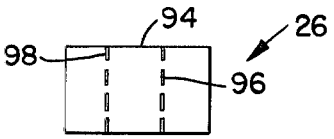
FIG. 17 is a top plan view of the cap component of FIG. 15 and showing the separation perforations.
Figure 18:
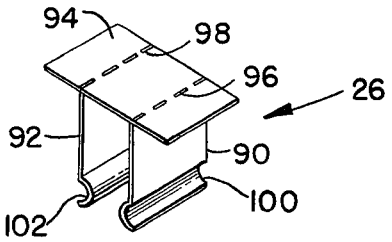
FIG. 18 is a perspective view of the cap component of FIG. 15 and also showing the separation perforations.

As may be seen in FIGS. 15 and 18, cap component 26 has a pair of locking indents 100 and 102 formed at the lower end of downwardly extending legs 90 and 92. As may be seen most clearly in FIG. 3, these indents 100 and 102 snap into cooperating lock slots 64 and 66 in the upper walls 60 and 62 of the upper components 24.

The structure of cap component 26 allows it to perform at least two distinct functions. As was discussed previously, the upper component 24 is fabricated in suitable lengths which can then be cut. It, however, is sometimes desirable to join together two or more upper components when a long joint is needed. Cap component 26 acts as a connecting element between two adjacent upper components 24 with the legs 90 and 92 bridging the gap and with the locking indents 100 and 102 and the lock slots 64 and 66 cooperating to hold the pieces together. It will, of course, be recognized that the cap component 26 is suitably sized to perform this function.

A second and perhaps more necessary function of cap component 26 is that of positioning the upper component 24 in the base component while the setting bed and the various other materials are hardening. Before the setting bed 30 has hardened, the upper component 24 could telescope into the base component 22 or 38. Once the setting bed 30 has hardened, the upper conponent 24 will not move vertically. As may be seen in FIGS. 1 and 2, the detachable tab 94 extends across the space between two adjacent floor tiles 32 and rests thereon. This tab 94 thus holds the upper component 24 at the proper height while the synthetic core material 54 is being placed in the upper chamber 52 of the upper component 24 and while the setting bed 30 is hardening. Once the setting bed 30 has hardened, the detachable tab 94 can be removed by tearing at perforation 96 and 98 thereby leaving an uninterrupted surface of core material 54 showing as a joint line in the upper chamber 52 of the upper component 24. The legs 90 and 92 of the cap component 26 stay in place adjacent the side walls 60 and 62 of the upper component 24 but they are of minimal thickness and are not readily seen.

In a typical installation, the concrete slab 28 and setting bed 30 are installed and prepared as is conventionally done. The floor tile is then placed as desired until a point is reached where it is desired to install the expansion and contraction joint assembly of the present invention. At that time, the setting bed is removed with a trowel or other suitable tool, in the area of the desired installation of the expansion and contraction joint assembly. The base component, either base 22 or 38, is placed with its lower portion contacting the slab 28. Next, the upper component 24 is telescopingly inserted into the base and is pushed downwardly only far enough to insure engagement. The removed setting bed is then replaced and fills in around the base component and the locking ridges. The floor tiles 32 are then set and leveled on the setting base 30 and the cap component 26 is secured to the upper component. The cap component can alternatively be placed on the upper component before the setting bed is replaced and the tile positioned, if the thicknesses of the materials so warrants. The upper component is then telescoped into the base component 22 until the tabs 94 of the cap component 26 contact the upper surfaces of the floor tiles. The core material 54 can be put into the open upper chamber 52 of the upper component 24 as dictated by the type of core material being used. The assembled floor and joint assembly is checked to be sure it is level and correctly installed and is then left for the setting bed and any grout used to harden. After hardening has been accomplished, the detachable tabs 94 may be removed at the perforations 96 and 98 leaving the expansion and contraction joint assembly secured in place.

If the floor tiles or setting bed or the concrete slab expand or contract, the expansion and contraction joint assembly in accordance with the present invention will compress or extend to accommodate such expansion or contraction so that the floor will not buckle or crack. The base component 22 is hollow and is joined to the setting bed by the locking ridges. This base component can expand or contract horizontally because of the resilient nature of the walls and the pleated or creased bottom. The upper component 24 is resilient because of its flexible wall structure and the synthetic core material 54 which is placed in the upper chamber 52. Thus the upper component 24 will also absorb expansion or contraction of the setting bed 30 and the floor tiles 32. Accordingly, the expansion and contraction joint assembly in accordance with the present invention will allow the inevitable expansion and contraction of the floor while eliminating buckling and cracking or breaking of the floor.

While preferred embodiments of an expansion and contraction joint assembly in accordance with the present invention have been set forth fully and completely hereinabove, it will be obvious to one of ordinary skill in the art that changes can be made without departing from the true spirit and scope of the disclosed invention. For example, the specific materials used for the components; the material used for the resilient core; the shapes of the locking ridges, slots, and indents; the dimensions and thicknesses of the materials used; and the like could be varied. Accordingly, the invention is to be limited only by the appended claims.

I claim:

1. An expansion and contraction joint assembly positionable between spaced floor tiles, the tiles being placed in a setting bed which is supported by a slab base, said joint assembly comprising:

a base component, said base component being an elongated channel having a hollow interior, spaced side walls, and a connecting bottom, at least one of said side walls having external locking ridges extending along said channel, bottom portions of said side walls contacting the slab;

an upper component in the form of a rectangular channel having a wedge shaped lower part telescopingly positionable in said hollow interior of said base component, side walls provided with lock slots, and an open upper chamber;

a cap component having downwardly extending legs and a detachable tab extending between said legs, said legs having locking indents which cooperate with said lock slots to secure said cap component to said upper component; and a resilient core positionable in said upper chamber of said upper component, said joint assembly being positionable between adjacent ones of the floor tiles with an upper surface of said core being adjacent an upper surface of the floor tiles, said joint assembly being adapted to compensate for expansion and contraction of said slab, setting bed, and floor tiles.

2. An expansion and contraction joint assembly for use in a floor which has a slab base, a setting bed on the slab and spaced floor tiles on the setting bed, said joint assembly comprising:

a base component positionable on the slab and having a hollow interior;

an upper component having a lower part telescopingly receivable in said hollow interior of said base component, and an open upper chamber;

a cap component having downwardly extending legs and a detachable tab extending between said legs, said legs having locking indents which cooperate with locking slots in side walls of said upper component, said cap component being positionable on said upper component; and a resilient core positionable in said open upper chamber of said upper component, said joint assembly being positionable between adjacent ones of the spaced floor tiles with an upper surface of said core being adjacent an upper surface of the floor tiles when the joint assembly is installed.

* * * * *